United States Patent [19]

Chance et al.

[11] Patent Number: 4,538,360

[45] Date of Patent: Sep. 3, 1985

[54] STEAM HEATED DRYER DRUM HAVING STATIONARY SIPHON AND SPOILER BARS

[75] Inventors: James L. Chance, Rockton, Ill.; Gregory L. Wedel, Beloit, Wis.

[73] Assignee: Beloit Corporation, Beloit, Wis.

[21] Appl. No.: 593,258

[22] Filed: Mar. 26, 1984

[51] Int. Cl.[3] ..... F26B 13/18

[52] U.S. Cl. ..... 34/41; 34/110; 34/125; 165/89

[58] Field of Search ..... 34/110, 124, 125, 119, 34/41; 165/89

[56] References Cited

U.S. PATENT DOCUMENTS

| | | | |
|---|---|---|---|
| 2,934,831 | 5/1960 | Tasker | 34/125 |
| 3,217,426 | 11/1965 | Barnscheidt et al. | 34/110 |
| 3,553,849 | 1/1971 | Carrier et al. | 34/124 |
| 3,724,094 | 4/1973 | Appel et al. | 34/124 |
| 4,155,177 | 5/1979 | Justus | 34/124 |
| 4,183,149 | 1/1980 | Chance et al. | 34/41 |
| 4,359,829 | 11/1982 | Schiel | 34/124 |

FOREIGN PATENT DOCUMENTS

| | | | |
|---|---|---|---|
| 950720 | 2/1964 | United Kingdom | 34/125 |

*Primary Examiner*—Larry I. Schwartz

*Attorney, Agent, or Firm*—Hill, Van Santen, Steadman & Simpson

[57] ABSTRACT

Substantially uniform heat transfer through the cylindrical heat transfer wall of a steam heated hollow dryer drum is attained by longitudinal spoiler bars effecting turbulence of condensate throughout a major extent of the inner surface of the heat transfer wall, and condensate turbulence is generated in a narrow annular area from which a stationary siphon intake head withdraws the condensate from the steam chamber. A turbulence promoter is carried by the intake head and may comprise rigid or yieldably supported structure, e.g. a brush, rigid or flexible bar structure, an array of fingers, mounted on the downstream or off-running side of the intake head having regard to the direction of rotation of the drum.

21 Claims, 5 Drawing Figures

STEAM HEATED DRYER DRUM HAVING STATIONARY SIPHON AND SPOILER BARS

BACKGROUND OF THE INVENTION

1. Field of the Invention

This invention relates to improvements in steam heated rotary dryer drums of the type used in paper making machines wherein wet paper web is dried by passing the same through a dryer which generally comprises a plurality of rotatably mounted drums over which the web is threaded for evaporating moisture from the web, and is more particularly directed to the attainment of substantially uniform heat transfer throughout the heating surface of a steam heated dryer drum equipped with spoiler bars and stationary siphon means.

2. Prior Art

In order to attain maximum production, often referred to as tonnage, in a paper making machine, every step in production must be as nearly as practicable fine tuned for maximum efficiency. Not the least of the production steps resides in the drying of the wet paper web. For high speed drying and dryer economy, it is imperative to secure the maximum drying heat from the steam supplied to the hollow dryer drums.

Conventionally, the web to be dried is held in contact with a series of the dryer drums which are generally large cast iron cylindrical shells closed at each end and steam heated and rotated at the speed of travel of the web. The steam supplied for heating the drums condenses as the heat is transferred through the cylindrical dryer shell wall. Centrifugal action causes the condensate to form a thin layer around the entire cylindrical inside surface of the drum which produce an insulating effect and reduces the rate of heat transfer from the steam through the drum to the web being dried. The reduction in drying rate thus caused is disadvantageous not only for steam economy reasons but also for heating efficiency reasons. A particular problem arises when the condensate layer is relatively thick and the desired dryer speed is high.

In order to evacuate the condensate and at the same time maintain as thin a film of the condensate as possible, siphons are provided which extend from outside of the dryer drum through rotary seals and have suction intakes located within a fraction of an inch of the inner surface of the dryer shell. These siphons may either be rotary, that is secured to the dryer shell and rotating with it, or stationary, that is with the intake suspended above the low point in the rotation of the inner surface of the dryer shell.

For efficiency the stationary form of siphon is preferred because it does not require unusual differential suction pressure since there are no centrifugal forces to overcome. However, the stationary siphon intake cannot be accurately located close to the cylindrical dryer shell wall surface because of the difficulty in providing the required mechanical rigidity through the dryer journal and rotary seal. The necessary siphon-to-shell wall clearance therefore results in a condensate layer which tends to unduly impede the heat transfer efficiency of the dryer drum. For overcoming this deficiency by reducing the effect of the rimming insulating layer of condensate numerous and varied arrangements have been proposed such as condensate removal pipes and other devices to minimize the condensate layer thickness, but it is impossible to eliminate the layer completely, and even a very thin layer of condensate will have a detrimental insulating effect.

Substantial improvement has been attained by providing the inner cylindrical surface of the dryer drum with circumferentially spaced and generally axially extending spoiler bars, exemplified in U.S. Pat. Nos. 3,217,426 and 3,724,094. These spoiler bars permit the condensate depth to be significantly thicker without impeding the heat transfer because of the resonant action of the condensate between the bars, and more particularly by virtue of the turbulence of the condensate effected by action of the bars. The spoiler bar action is especially well described and illustrated in U.S. Pat. No. 3,724,094, and to whatever exent necessary the disclosure of that patent is incorporated herein by reference. These spoiler bars are especially well suited to dryer drums with stationary siphons.

However, a problem has been encountered in the stationary siphon and spoiler bar arrangement, because the ends of the bars adjacent to the siphon cannot be placed closely to or under the intake tip of the stationary siphon without risking potential mechanical interference. Without the spoiler bars in the narrow annular heat transfer area of the drum wall which rotates past the siphon intake, there is a condensate rimming, i.e. centrifugal accumulation, effect and the heat transfer from this narrow area tends to be poor in comparison with the rest of the drying surface of the dryer drum. This causes non-uniformity in the moisture content of the paper web being dried by leaving the longitudinal area of the web along the narrow siphon intake area of the dryer drum with an undesirable moisture content compared to the remainder of the web.

A proposal for eliminating the non-uniform heat transfer problem is disclosed in U.S. Pat. No. 4,183,149, wherein instead of spoiler bars, a brush is mounted to extend longitudinally throughout the width of the effective heat transfer surface of the drum. Such brush is mounted stationarily within the drum and circumferentially spaced from the vertical disposition of the siphon which is connected to an axial tube on which the brush is mounted. This mounting tube must extend substantially throughout the length of the steam chamber in the drum and requires bearings at each end. Furthermore, the scheme presumes the elimination of spoiler bars on the dryer drum chamber wall, and therefore does not solve the problem for existing dryer drums equipped with spoiler bars and stationary siphons. Nor does the patented spoiler brush arrangement solve the problem where for any reason the spoiler bar and stationary siphon arrangement may be preferred for original equipment dryer drums in a new dryer assembly.

SUMMARY OF THE PRESENT INVENTION

In accordance with the principles of the present invention, the problem of non-uniform heat transfer in a steam heated hollow dryer drum equipped with spoiler bars and stationary siphon means is corrected.

To this end, there is provided by the present invention in combination in a steam heated hollow dryer drum adapted to be mounted for rotation with its perimeter in content with a web to be dried, the drum defining a steam chamber within a shell having a thin cylindrical heat transfer wall and opposite end closures, means for introducing steam into the chamber, a stationary siphon within the chamber and having an intake head for drawing off condensate along an annular relatively narrow area of an inner surface of the wall adjacent to one of the end closures, and which narrow area rotates past the intake head, and comprising means for attaining efficiently uniform heat transfer through the wall, including circumferentially spaced spoiler bars extending longitudinally on a major area of said inner surface of the wall between said narrow area and the opposite end closure for effecting turbulence of condensate to improve heat transfer through such major area in the rotation of the drum; and turbulence promoting means carried by the intake head and projecting toward said narrow annular area for effecting turbulence of the condensate and improved heat transfer in the narrow area as the narrow area rotates past the intake head.

The present invention also provides a method of attaining substantially improved heat transfer through the spoiler bar area as well as the siphon means area of a steam heated hollow dryer drum.

BRIEF DESCRIPTION OF DRAWINGS

Other objects, features and advantages of the present invention will be readily apparent from the following description of certain representative embodiments thereof, taken in conjunction with the accompanying drawings, although variations and modifications may be effected without departing from the spirit and scope of the novel concepts embodied in the disclosure, and in which.

DETAILED DESCRIPTION

Figure 1:
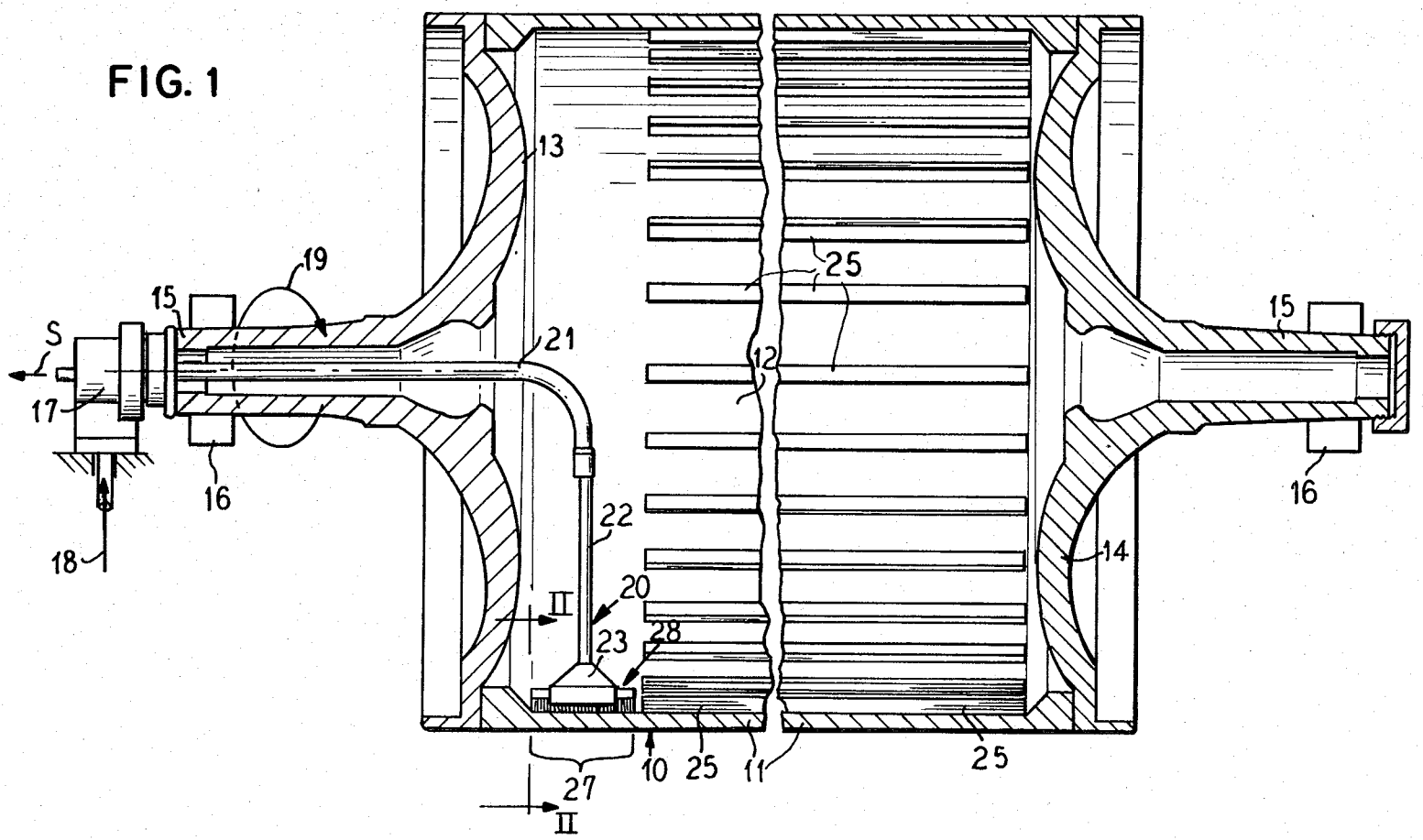
FIG. 1 is a fragmental longitudinal sectional detail view through a dryer drum embodying the invention.

As more or less schematically disclosed in FIG. 1, a dryer drum 10 embodying the invention comprises a cylindrical metal heat transfer shell wall 11 defining therein a chamber 12 closed at one end by an end wall or closure 13, sometimes referred to as a dryer head, and closed at the opposite end by means of a similar end wall or closure 14. Each of the end closures 13 and 14 has an axially outwardly extending hollow journal 15 adapted to be supported in suitable bearings 16 as is conventional and well known in this art. Also conventional means (not shown) may be provided for rotatably driving the dryer drum 10.

One of the hollow journals 15, herein the journal for the end closure 13, is adapted to serve as a heating steam inlet for receiving through a so-called rotary seal having a stationary housing 17 steam under suitable pressure from a source schematically identified as 18, the steam entering into and filling the chamber 12. Heat, provided by the steam, transfers through the drum shell wall 11 and has drying effect on the moisture containing wet web running on the outer surface of the wall 11 in the rotation of the drum 10 as indicated by directional arrow 19. As heat transfer cools the steam, the steam condenses and the condensate must be removed from the chamber 12.

Condensate removal is effected, as shown by directional arrow S, by means of a siphon 20, preferably of the stationary type, having a pipe 21 extending fixedly from the seal housing 17 coaxially through the associated hollow journal 15 into the chamber 12 and connected to a riser pipe stem 22 directed radially downwardly toward the wall 11 adjacent to the end closure 13. At its lower, terminal end nearest the wall 11, the stem 22 carries a siphon tip or intake 23 comprising a head having its intake mouth face **23*a* located as closely as practicable adjacent to, but spaced from, the opposing surface of the wall 11 for the purpose of sucking up and removing condensate 24 (FIG. 2) from within the chamber 12**. The aim is to keep the layer of condensate as optimal as possible limited only by the closeness with which the mouth of the siphon can be positioned with respect to the drum chamber wall surface. For a stationary siphon, a scooping siphon mouth is not practical because of the difficulty in providing the required mechanical rigidity through the dryer journal and rotary seal and thus the virtual impossibility of maintaining an accurately close approach of the siphon to the cylindrical drum wall without at least some scrapping contact with the rotating wall. Therefore a compromise optimum spacing range of about 0.08 inch to 0.20 inch is desirably maintained, taking into consideration the diameter and operating speed of the dryer drum and possibly other parameters. Due to the rimming effect of the condensate caused by centrifugal force, the layer of condensate may tend to impede the transfer of heat and reduce drying efficiency, unless something is done to improve the heat transfer efficiency.

Excellent results have heretofore been obtained in significantly increasing the condensate heat transfer coefficient, thus efficiency, that is reduction in the insulating effect of the condensate layer, by equipping the steam chamber surface of the wall 11 with spoiler bars 25 extending longitudinally throughout the entire drying surface width of the wall 11 from adjacent to the siphon intake 23 to the opposite end closure 14 of the dryer drum 10. The thickness and circumferential spacing of the spoiler bars 25 may be calculated in accordance with the teachings of the beforementioned U.S. Pat. No. 3,724,094. A distinct advantage of these spoiler bars is that they permit the condensate depth to be thicker than where the heat chamber surface of the drum wall 11 is plain. Because the condensate layer may be thicker, the siphon to shell clearance may also be greater and facilitates use of the stationary siphon with its advantageous relatively low differential pressure requirements while allowing more tolerance for the stationary siphon mounting.

A problem nevertheless occurs because it is not practical to extend the spoiler bars 25 into and across the narrow annular area, identified at 27 in FIG. 1, along which the siphon intake draws off the condensate 24 in the operation of the rotating dryer drum 10. The tips of the spoiler bars 25 must terminate adjacent to the area 27 far enough removed from the siphon intake 23 to avoid the risk of mechanical interference and possible damage as the bars 25 rotate past the stationary siphon intake 23. Without the condensate turbulence effect of the spoiler bars 25 in the area 27, there is a tendency for rimming of the condensate, especially in the layer which remains at the offrunning side of the siphon head 23, having regard to the direction of rotation of the drum wall 11, and therefore the heat transfer through the area 27 tends to be substantially reduced as compared to the improved heat transfer through the remaining area of the drum wall 11 carrying the spoiler bars 25. This results in non-uniformity in the moisture content of the paper web being dried in the operation of the drum.

According to the present invention, the problem of rimming and non-uniform heat transfer in the area 27 is eliminated by providing antirimming promoting means on the siphon intake 23 for generating turbulence of the condensate layer on the surface of the narrow area 21, as the narrow area rotates past the intake 23, and therefore attaining improved heat transfer in the narrow area 27. In one preferred form, the spoiler means comprises a brush 28 having a body bar 29 of a length to extend across the major extent of the width of the area 27 and provided with brush bristles 30 along a lower edge of the bar and arranged to project downwardly into the condensate layer 24 and to generate turbulence to at least as effective a result as turbulence is generated by the spoiler bars 25. The bristles 30 may be formed from any material which will withstand the steam temperatures which may be typically in the 300° F. to 400° F. range, at steam pressures ranging to about 160 psig, and typically about 125 psig. Stainless steel or copper strands or other metal may be employed for the bristles 30.

Figure 2:
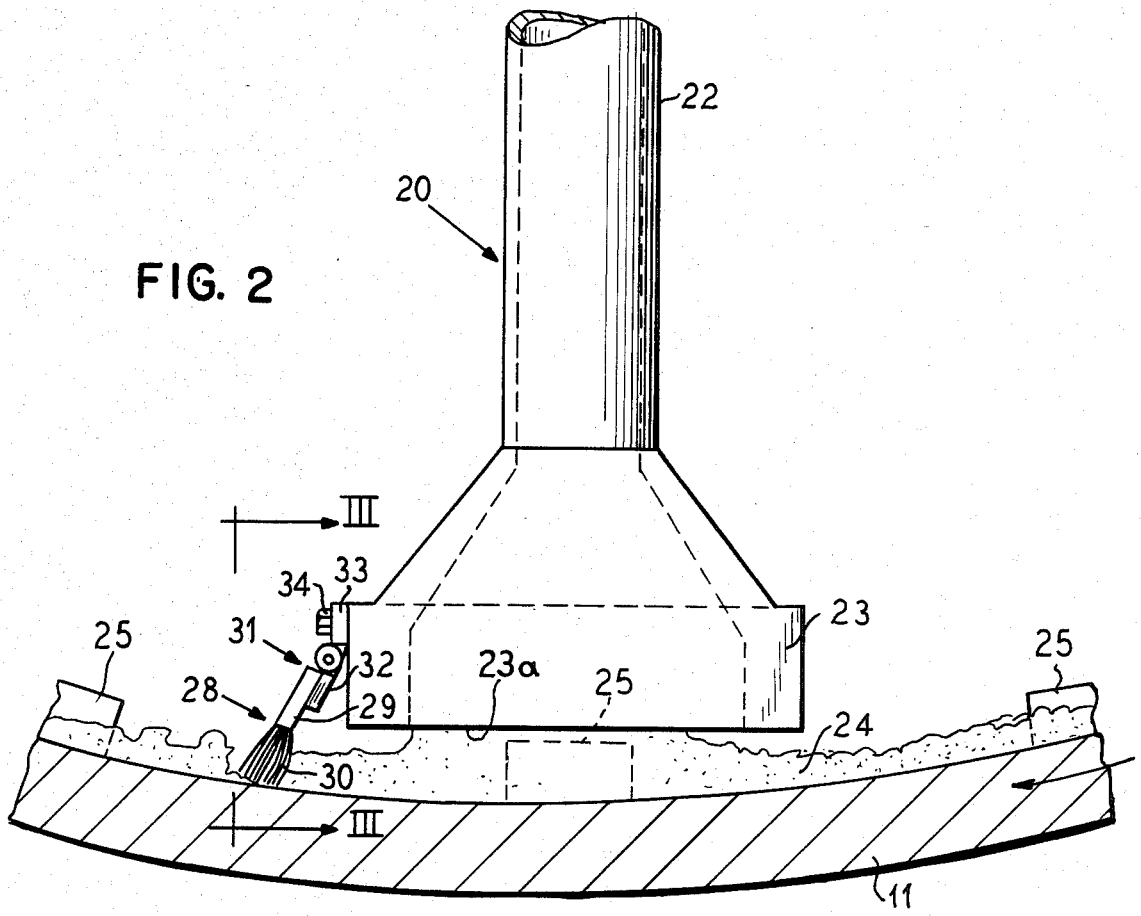
FIG. 2 is a vertical sectional detail view taken substantially along the line II—II in FIG. 1.
Figure 3:
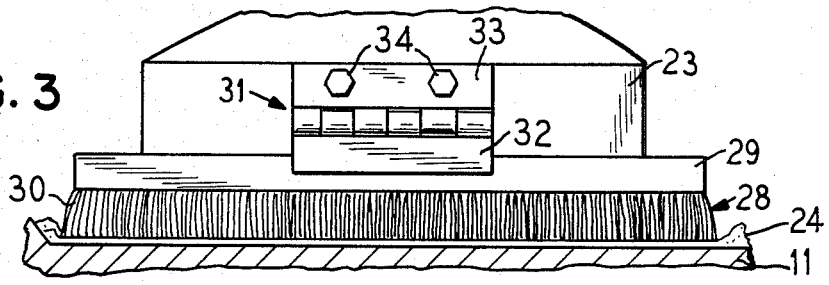
FIG. 3 is a fragmentary sectional elevational view taken substantially along the line III—III in FIG. 2.

Mounting of the spoiler brush 28 is desirably effected at the trailing edge or side of the siphon intake 23, that is the side which faces toward the off-running direction of the drum wall 11, and more particularly the area 27 with which the siphon 20 is associated. This assures that condensate or drum wall surface drag on the brush will be away from the intake 23. Although if preferred the brush 28 may be fixed rigidly to the head or intake 23, a preferred arrangement as best seen in FIGS. 2 and 3, resides in hingedly mounting the brush. A piano type hinge 31 may be employed, having one hinge plate 32 rigidly fixed to the bar 29 and the other hinge plate 33 secured as by means of screws 34 to the intake head 23. By having the hinge 31 as narrow as practical while yet maintaining adequate stability, and with the brush 28 extending a substantial distance beyond opposite sides of the hinge, there will be minimum liability of undesirable pileup of condensate on the downstream side of the brush 28 which might tend to flip the brush over the condensate layer and diminish its turbulence generating efficiency. On the other hand, it is desirable to have the brush 28, in effect, float in the condensate layer to generate maximum turbulence. In order to assure that for normal operation the brush will efficiently engage the condensate layer 24, the bar 29 may be weighted to anticipate the particular speed of operation intended for the dryer drum 10.

Figure 4:
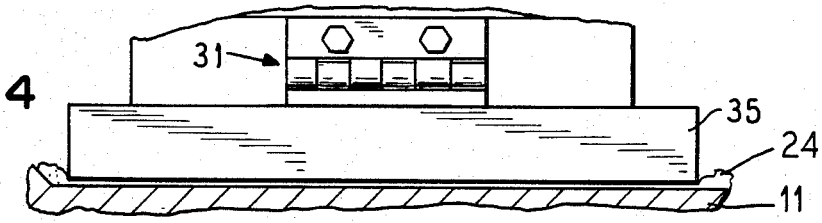
FIG. 4 is a view similar to FIG. 3 but showing a modification.

For some purposes, instead of a bristle brush, a bar or plate 35 (FIG. 4) may be substituted. This bar may be plain or notched along its lower edge or otherwise configurated, and may be of the same width and adapted for similar turbulence generating action in respect to the condensate layer 24 as described for the brush 28. While, the bar or plate turbulence generator or spoiler 35 may be mounted fixedly on the intake head 23, it may be mounted in substantially the same manner as the brush 28, that is by means of the hinge 31. Further, the bar or plate member 35 may be fairly thick and rigid or it may be thin and resiliently flexibly yieldable.

Figure 5:
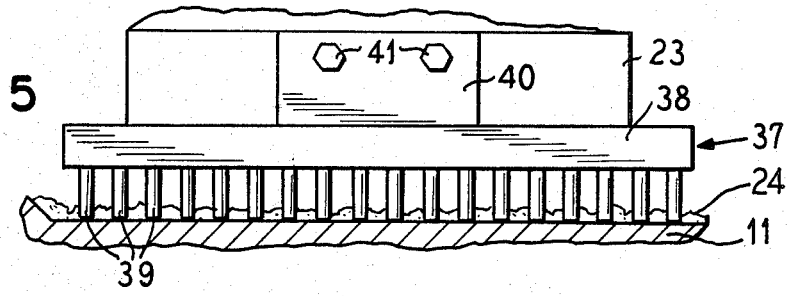
FIG. 5 is a view similar to FIGS. 3 and 4 but showing a further modification.

In another arrangement as shown in FIG. 5, a turbulence generator 37 may be employed comprising a body bar 38 similar to the brush body bar 29, but instead of carrying bristles, the bar 38 is equipped with depending agitator fingers 39. These fingers may be rods or pieces of tubing or may be simply cut into the lower edge of the body bar 38. The main consideration is that the fingers 39 provide for efficient turbulence generation in the condensate layer 24 by extending into the condensate layer even to the extent of the scraping the drum wall surface. Since the spoiler or turbulence generator 37 is on the downstream side of the intake head 23, there is little if any adverse effect from the fingers 29 touching the surface of the dryer shell, and may even have a beneficial effect where the condensate layer may tend to be minimal, so that even with the minimal thickness condensate layer condensate turbulence will continue to be generated to the same efficiency as the other forms of the spoiler or turbulence generators described. Mounting of the spoiler 37 may be in a hinged relatively floating manner as, for example, by means of the hinge 31, but may alternatively be mounted fixedly to the siphon intake head 23 as by means of a rigid attachment flange or extension 40 secured as by means of screws 41 to the intake head 23.

It will be understood that variations and modifications may be effected without departing from the spirit and scope of the novel concepts of this invention.

We claim as our invention:

1. In combination in a steam heated hollow dryer drum having means for mounting it for rotation with its perimeter in contact with a web to be dried, the drum defining a steam chamber within a shell having a thin cylindrical heat transfer wall and opposite end closures, means for introducing steam into the chamber, a stationary siphon within the chamber and having a downwardly extending intake head aligned in spaced relation over an annular relatively narrow area of an inner surface of said wall adjacent to one of said end closures, and which narrow area rotates past said intake head which draws off the condensate except for a layer of a thickness about equal to said spaced relation and extending from the offrunning side of the head so that rimming of the condensate layer is liable to occur in said area, and comprising means for attaining efficiently uniform heat transfer through said wall, including:

spoiler bars extending longitudinally on a major area of said inner surface of said wall between said narrow area and the opposite end closure for effecting turbulence of condensate to improve heat transfer through said major area in the rotation of the drum;

and turbulence promoting means carried by said offrunning side of said intake head and projecting from said head across the space between said head and the surface of said narrow annular area and into the condensate layer on said narrow area surface, for effecting turbulence of the condensate layer and thereby preventing rimming and attaining improved heat transfer through said narrow area surface during the rotation of said narrow area past said intake head.

2. A dryer drum according to claim 1, wherein said turbulence promoting means comprises a device mounted on the side of said intake head which faces in the off-running direction of said narrow area.

3. A dryer drum according to claim 2, wherein said device comprises a condensate engaging member extending across substantially the full width of said narrow annular area, and means for securing said means to said intake head.

4. A dryer drum according to claim 1, wherein said turbulence promoting means comprises a brush having depending bristles.

5. A dryer drum according to claim 4, including means for hingedly attaching said brush to said intake head.

6. A dryer drum according to claim 1, wherein said turbulence promoting means comprises a bar depending from said intake head.

7. A dryer drum according to claim 6, wherein said bar is rigid.

8. A dryer drum according to claim 6, wherein said bar is resiliently flexible.

9. A dryer drum according to claim 6, including means for hingedly attaching said bar to said intake head.

10. A dryer drum according to claim 1, wherein said turbulence promoting means comprises an array of depending fingers.

11. A dryer drum according to claim 10, comprising a bar carrying said fingers.

12. A dryer drum according to claim 1, wherein said intake head is narrower than said narrow area, and said turbulence promoting means extends throughout substantially the width of said annullar area.

13. A dryer drum according to claim 12, including means substantially narrower than said intake head for attaching said turbulence promoting means to said intake head.

14. A method of attaining efficiently uniform heat transfer through the thin cylindrical heat transfer wall of a rotating steam heated hollow dryer drum with its perimeter in contact with a web to be dried and with end closures at the opposite ends of a steam chamber defined within the drum, comprising:

introducing steam into said chamber for heat transfer through said wall to the web;

collecting condensate on the surface of said wall within said steam chamber;

effecting turbulence of condensate to improve heat transfer through a major area of said wall surface by action of spoiler bars extending between one of said end closures and a narrow annular area of said wall adjacent to the other of said end closures;

withdrawing condensate from said chamber at said narrow area through a stationary siphon having an intake head radially spaced from the surface of said narrow area, and into which siphon the condensate is drawn from said narrow area as said narrow area moves past said intake head;

and directing antirimming, turbulence promoting means carried by said head to extend across the space between the head and said narrow annular area and into the condensate on said narrow area surface and thereby effecting antirimming turbulence of the condensate and improved heat transfer through said narrow area surface as said narrow area rotates past said intake head.

15. A method according to claim 14, which comprises mounting a brush on said intake head to provide said turbulence promoting means.

16. A method according to claim 14, which comprises operating said turbulence promoting means floatingly in said condensate layer.

17. A method according to claim 14, which comprises extending said turbulence promoting means from a rigid mount on said intake head.

18. A condensate siphon for a steam heated rotary dryer drum, comprising:

stationary siphon stem having a terminal intake head having a suction face adapted to be located in adjacently spaced aligned relation to, an interior wall surface of the drum for withdrawing condensate from said wall surface during rotation of said surface past said head;

and turbulence promoting means carried by said head and extending past said suction face and adapted for projecting across the spaced between said suction face and said surface and into and effecting turbulence of the condensate.

19. A condensate siphon according to claim 18, wherein said turbulence promoting means comprises a yieldable structure.

20. A condensate siphon according to claim 18, wherein said turbulence promoting means is a rigid structure.

21. In combination in a steam heated hollow dryer drum adapted to be mounted for rotation with its perimeter in contact with a web to be dried, the drum defining a steam chamber within a shell having a thin cylindrical heat transfer wall and opposite end closures, means for introducing steam into the chamber, a stationary siphon within the chamber and having an intake head for drawing off condensate along an annular relatively narrow area of an inner surface of said wall adjacent to one of said end closures, and which narrow area is necessarily spaced from and rotates past said intake head so that rimming of the condensate is liable to occur in said area, and comprising means for attaining efficiently uniform heat transfer through said wall, including:

spoiler bars extending longitudinally on a major area of said inner surface of said wall between said narrow area and the opposite end closure for effecting turbulence of condensate to improve heat transfer through said major area in the rotation of the drum;

turbulence promoting means carried by said intake head and projecting toward said narrow annular area for effecting turbulence of the condensate and thereby preventing rimming and attaining improved heat transfer in said narrow area as said narrow area rotates past said intake head;

said turbulence promoting means comprising a bar depending from said intake head;

and means for hingedly attaching said bar to said intake head.

* * * * *